US006739957B2

(12) United States Patent
Peterson et al.

(10) Patent No.: US 6,739,957 B2
(45) Date of Patent: May 25, 2004

(54) APPARATUS FOR RECIPROCALLY POWERING ONE OR MORE WORKING TOOLS

(76) Inventors: Clayton R. Peterson, 63 Calle Cadiz, Unit D, Laguna Woods, CA (US) 92653; Steve Sanders, 2318 N. Baker St., Santa Ana, CA (US) 92706

( * ) Notice: Subject to any disclaimer, the term of this patent is extended or adjusted under 35 U.S.C. 154(b) by 0 days.

(21) Appl. No.: 10/308,404

(22) Filed: Dec. 3, 2002

(65) Prior Publication Data

US 2003/0104774 A1 Jun. 5, 2003

Related U.S. Application Data

(60) Provisional application No. 60/336,592, filed on Dec. 4, 2001.

(51) Int. Cl.[7] ..... B24B 7/00; B28D 1/26

(52) U.S. Cl. ..... 451/162; 451/164; 451/351; 451/356; 451/119; 125/40; 299/36.1; 299/37.1

(58) Field of Search ..... 451/157, 162, 451/164, 174, 351, 353, 356, 119, 155, 158, 160; 125/40; 299/36.1, 37.1, 37.3

(56) References Cited

U.S. PATENT DOCUMENTS

| | | | | |
|---|---|---|---|---|
| 2,669,812 A | * | 2/1954 | Champayne | |
| 3,128,581 A | | 4/1964 | Tosetti | 51/177 |
| 3,580,638 A | | 5/1971 | Pullen | 299/125 |
| 4,186,967 A | | 2/1980 | Kuhmonen | 299/25 |
| 4,242,837 A | * | 1/1981 | Lohse | |
| 4,451,093 A | * | 5/1984 | Perez | 299/88 |
| 4,614,380 A | * | 9/1986 | Allen | 299/41 |
| 5,275,470 A | * | 1/1994 | Miller | 299/41 |

* cited by examiner

*Primary Examiner*—Eileen P. Morgan
(74) *Attorney, Agent, or Firm*—Flanagan & Flanagan; John R. Flanagan

(57) ABSTRACT

A surface abrader apparatus includes a casing, a motor mounted on the casing, one or more working tools, and an operating mechanism mounted to the casing and supporting the working tools outside of the casing. The operating mechanism is drivingly coupled to the motor for causing an impacting movement of the working tools against a workpiece in response to selected operation by the motor. The operating mechanism includes one or more elongated shafts reciprocally mounted in the casing parallel to one another and having same one ends extending from the casing, a drive shaft rotatably mounted in the casing between and parallel to the shafts and rotatably driven by the motor, and coil springs and cam elements for causing lifting and releasing of the shafts and the working tools, such as impact abrading heads, mounted on the same one ends of the shafts to produce impact movements of the tools.

24 Claims, 4 Drawing Sheets

APPARATUS FOR RECIPROCALLY POWERING ONE OR MORE WORKING TOOLS

This utility patent application claims the benefit of U.S. provisional application No. 60/336,592, filed Dec. 4, 2001.

BACKGROUND OF THE INVENTION

1. Field of the Invention

The present invention generally relates to an apparatus for reciprocally powering one or more working tools and, more particularly, is concerned with a surface abrader apparatus employing such mechanism for reciprocally powering multiple impact abrading heads.

2. Description of the Prior Art

In the construction industry it is frequently necessary to abrade or roughen surfaces of concrete and other hard materials in order to prepare or refurbish the surfaces for bonding with other materials that are later applied thereto. It would be desirable to have an apparatus available that could be used to accomplish this task at a reasonable cost.

However, heretofore surface abrader machines, such as floor scabbler machines, typically have been air driven and relatively expensive to run. Because these machines are air driven, they require that a separate air compressor be brought to the work site to supply the compressed air to operate the machine. For instance, a typical floor scabbler machine needs an 180 cubic feet or larger air compressor to run even a relatively small floor scabbler machine.

Consequently, a need still exists for an innovation which will provide a solution to the aforementioned problem in the prior art without introducing any new problems in place thereof.

SUMMARY OF THE INVENTION

The present invention provides an apparatus for reciprocally powering one or more working tools to perform a variety of impact functions in a cost-effective manner and so satisfy the aforementioned need.

Accordingly, the present invention is directed to an apparatus which comprising: (a) a casing; (b) a motor mounted on the casing; (c) one or more working tools; and (d) an operating mechanism mounted to the casing and supporting the working tools outside of the casing. The operating mechanism is drivingly coupled to the motor for causing an impacting movement of the working tool against a surface in response to selected operation by the motor. The operating mechanism includes one or more elongated shafts reciprocally mounted in the casing parallel to one another and having same one lower ends extending from the casing, an input drive shaft rotatably mounted in the casing between and parallel to the shafts and rotatably driven by the motor, and means for lifting and releasing the shafts and the working tools mounted on the same one ends of the shafts to produce impact movements of the tools.

The means for lifting and releasing the shafts to reciprocally drive them along parallel axes includes a plurality of cam follower flanges each attached about one of the shafts and a plurality of coil springs each surrounding an upper end of one of the shafts opposite the lower end thereof supporting the working tool. The coil springs being upwardly yieldable are adapted to impose downwardly directed biasing forces on the cam follower flanges. The cam follower flanges and thus their shafts are sequentially lifted against the biasing forces of the coil springs and then abruptly released due to their engagement with an annular surface of a predetermined contour on an annular drive cam of the input drive shaft rotatably coupled to and driven by a rotary output shaft of the motor. Upon being abruptly released the shafts are driven downwardly along their parallel axes due to the biasing forces imposed on the flanges by the coil springs so as to cause forceable impact of their working tools with the surface. The shafts also are rotatably mounted such that the contacting of the annular drive cam on the rotating input drive shaft with the cam follower flanges on the shafts turns the shafts and the working tools therewith such that different areas of the surface are impacted by the tools.

In a preferred form, the apparatus is a surface abrader and the working tools are impact abrading heads adapted to forceably impact and abrade or roughen a surface, such as, of concrete or other relatively hard material.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
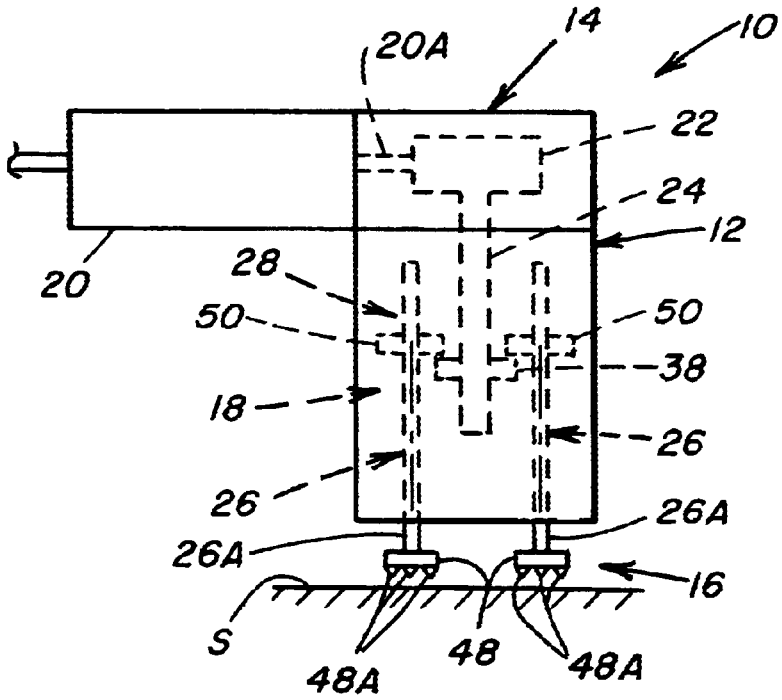
FIG. 1 is an overall side elevational view of a surface abrader apparatus of the present invention.

Referring to the drawings and particularly to FIG. 1, there is illustrated a surface abrader apparatus of the present invention, generally designated 10, which can take the form of a hand tool, such as shown in FIG. 1, or can be incorporated into a larger machine (not shown), to accomplish the aforementioned surface abrading or roughening task. The surface abrader apparatus 10 basically includes a casing 12, a source 14 of motive power mounted on the casing 12, one or more working tools 16, and an operating mechanism 18 mounted to the casing 12 and supporting the working tools 16 outside of the casing 12. The motive power source 14 includes a motor 20 having a rotary output shaft 20A and a drive train 22 for transmitting the rotary motion of the output shaft 20A to the operating mechanism 18. The operating mechanism 18 is drivingly coupled to the motor 20, via the drive train 22, and adapted to bring an impacting movement of the working tools 16 against a surface S in response to selected operation by the motor 20.

The operating mechanism 18 includes an input drive shaft 24 rotatably mounted in the casing 12, at least one and preferably a plurality of elongated shafts 26 reciprocally mounted in the casing 12 parallel to one another and having lower ends 26A extending from the casing 12, and means 28 for lifting and releasing the shafts 26 and the working tools 16 mounted on the lower ends 26A of the shafts 26 to reciprocally drive the shafts 26 along parallel axes R to produce impact movements of the working tools 16. The input drive shaft 24 is disposed between and parallel to the shafts 26 and is rotatably driven by the rotary output shaft 20A of the motor 20 via the drive train 22. Thus, the shafts 26 are reciprocally movably mounted to the casing 12 at locations radially displaced outwardly from the input drive shaft 24. The motor 20 can be an electric or hydraulic motor. The drive train 22 can be a suitable gear box for transmitting the rotary drive motion of the output shaft 20A of the motor 20 to the input drive shaft 24 of the operating mechanism 18.

Figure 3:
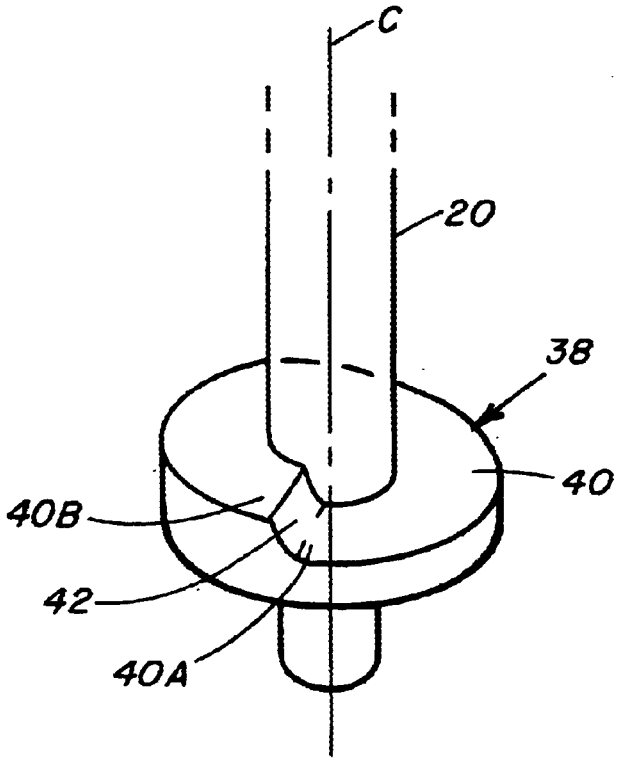
FIG. 3 is a perspective view of an input drive shaft of the operating mechanism and an annular drive cam attached about the input drive shaft.
Figure 2:
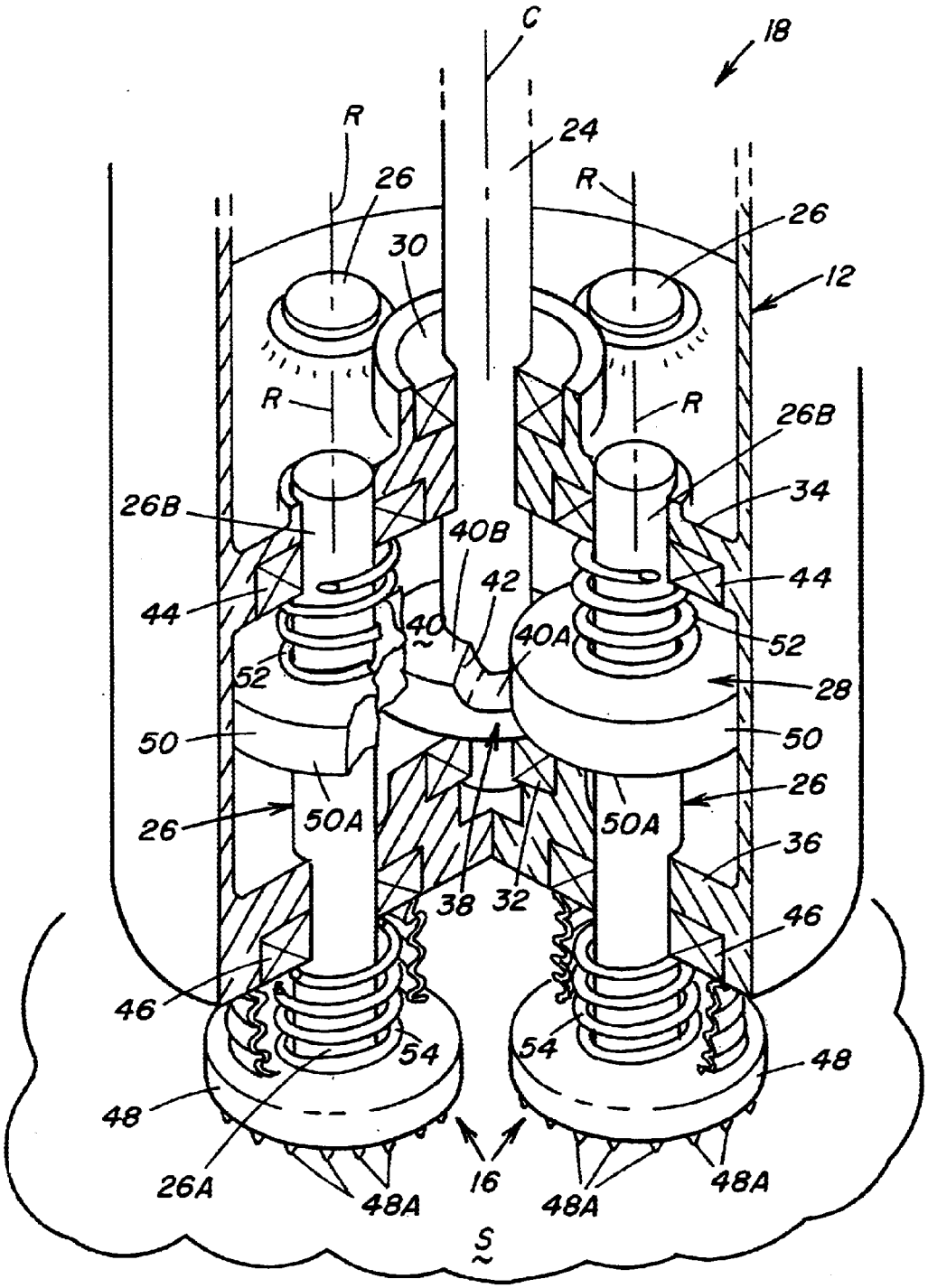
FIG. 2 is a longitudinally cutaway perspective view of a first embodiment of an operating mechanism employed by the apparatus of FIG. 1.

Referring to FIGS. 2 and 3, there is illustrated a first embodiment of the operating mechanism 18 of the apparatus 10 shown in a vertical orientation relative to a surface S to be abraded by the shafts 26 of the operating mechanism 18. The input drive shaft 24 in this first embodiment is rotatably mounted by a set of axially displaced upper and lower bearings 30, 32 supported in a pair of spaced apart upper and lower walls 34, 36 of the casing 12. The operating mechanism 18 has an annular-shaped drive cam 38 affixed to and surrounding the input drive shaft 24 intermediately between the upper and lower bearings 30, 32. The drive cam 38 defines an upwardly facing cam surface 40 having a gradually-inclined helical configuration with opposite lower and upper ends 40A, 40B of the cam surface 40 vertically displaced from one another and interconnected by a steeply-inclined ledge 42.

There are four elongated shafts 26 in this first embodiment of the operating mechanism 18 which are mounted by corresponding sets of axially displaced upper and lower bearings 44, 46 supported in the spaced walls 34, 36 of the casing 12 at locations radially displaced outwardly from the drive shaft 24 and angularly displaced approximately 90° from each other. The input drive shaft 24 is mounted to undergo rotation about a central longitudinal axis C. The shafts 26 are mounted to undergo upward and downward reciprocal movement along respective longitudinal axes R which extend generally parallel to one another and to the central longitudinal axis C of the drive shaft 24. The shafts 26 are also free to rotate about their longitudinal axes R due to their frictional engagement with the rotating input drive shaft 24. Also, the working tools 16 are cylindrical abrading heads 48 fixedly attached at the lower ends 26A of the shafts 26 with abrading dimples 48A defined on lower faces 48B of the heads 48.

The means 28 for lifting and releasing the shafts 26 to reciprocally drive them along the parallel axes R includes a plurality of cam follower flanges 50 each fixedly attached about one of the shafts 26 at locations spaced below upper ends 26B of the shafts 26. The annular cam follower flanges 50 at downwardly-facing surfaces 50A partially overlie and overlap the upwardly-facing cam surface 40 of the drive cam 38. The means 28 also includes sets of upper and lower hold-down coil springs 52, 54 provided about the shafts 26 between the abrading heads 48 and the lower wall 36 of the casing 12 and between the annular flanges 50 and the upper wall 34 of the casing 12 so as to impose downwardly-directed biasing forces on the flanges 50, shafts 26 and abrading heads 48. Thus, as the input drive shaft 24 is caused to rotate in a clockwise direction through one revolution about its longitudinal axis C, the shafts 26 reciprocally move along their longitudinal axes R through upward and downward strokes of one reciprocal cycle. As the drive shaft 24 so rotates, the annular flanges 50 are held by the upper hold-down coil springs 52 against the drive cam 38 such that the flanges 50 ride up the gradually sloping cam surfaces 40 from the lower end 40A to the upper end 40B thereof and the shafts 26 move upwardly away from the surface S during upward strokes of the shafts 26. Once the flanges 50 have passed over the upper ends 40B of the cam surfaces 40 and past the ledges 42 as the drive shaft 24 continues its rotation, the downward bias forces of the coil springs 52, 54 being constantly exerted on the flanges 50 causes the shafts 26 to be driven downwardly to the lower ends 40A of the cam surfaces 40 during downward strokes of the shafts 26 such that abrading dimples 48B on the abrading heads 48 are driven with forceable impact into the surface S so as to cause the abrading thereof. As one example, when the drive shaft 24 is turned at 2500 revolutions per minute, the reciprocal shafts 26 would provide 10,000 impacts per minute on the surface S.

Also as mentioned earlier, the shafts 26 are mounted so as to be free to rotate in addition to being reciprocal along axes R. The engagement of the rotating drive cam 38 on the drive shaft 24 with the cam follower flanges 50 on the shafts 26 not only results in the axial reciprocal movement but also partial rotation or turning of the shafts 26 about the axes R which, in turn, results in the abrading dimples 48A of the abrading heads 48 hitting different areas of the surface S upon each impact of the dimples 48A with the surface S which assists in accomplishing faster abrading of the surface S.

Thus, the shafts 26, adapted to forceably impact the abrading heads 48 with the surface S to abrade or roughen the surface S, are rotatably and vertically reciprocally driven through the combined action of the upwardly-yieldable downwardly-directed biasing forces imposed on respective cam follower flanges 50 and abrading heads 48 on the shafts 26 by the sets of hold-down coil springs 52, 54 and of the sequential vertical lifting and releasing of the flanges 50 due to their engagement with the predetermined contour of the annular surface 40 on the annular drive cam 38 on the rotatable input drive shaft 24 being rotatably coupled to and driven by the rotary output shaft 20A of the motor 20. More particularly, the cam follower flanges 50 and thus their shafts 26 are sequentially lifted against the biasing forces of the coil springs 52, 54 due to engagement with the annular cam surface 40 on the annular drive cam 38 and then abruptly released due to passing the ledge 42 on an annular drive cam 38. Upon being abruptly released the shafts 26 are driven downwardly along their parallel axes R due to the biasing force imposed on the flanges 50 and heads 48 by the coil springs 52, 54 to cause forceable impact of the abrading heads 48 with the surface S. Also, by using a variety of coil springs 52, 54 of different tensions thereby imposing different biasing forces on the flanges 50, a variety of surface profiles can be created, allowing an ability to create, as needed, a special profile on the surface S.

Figure 4:
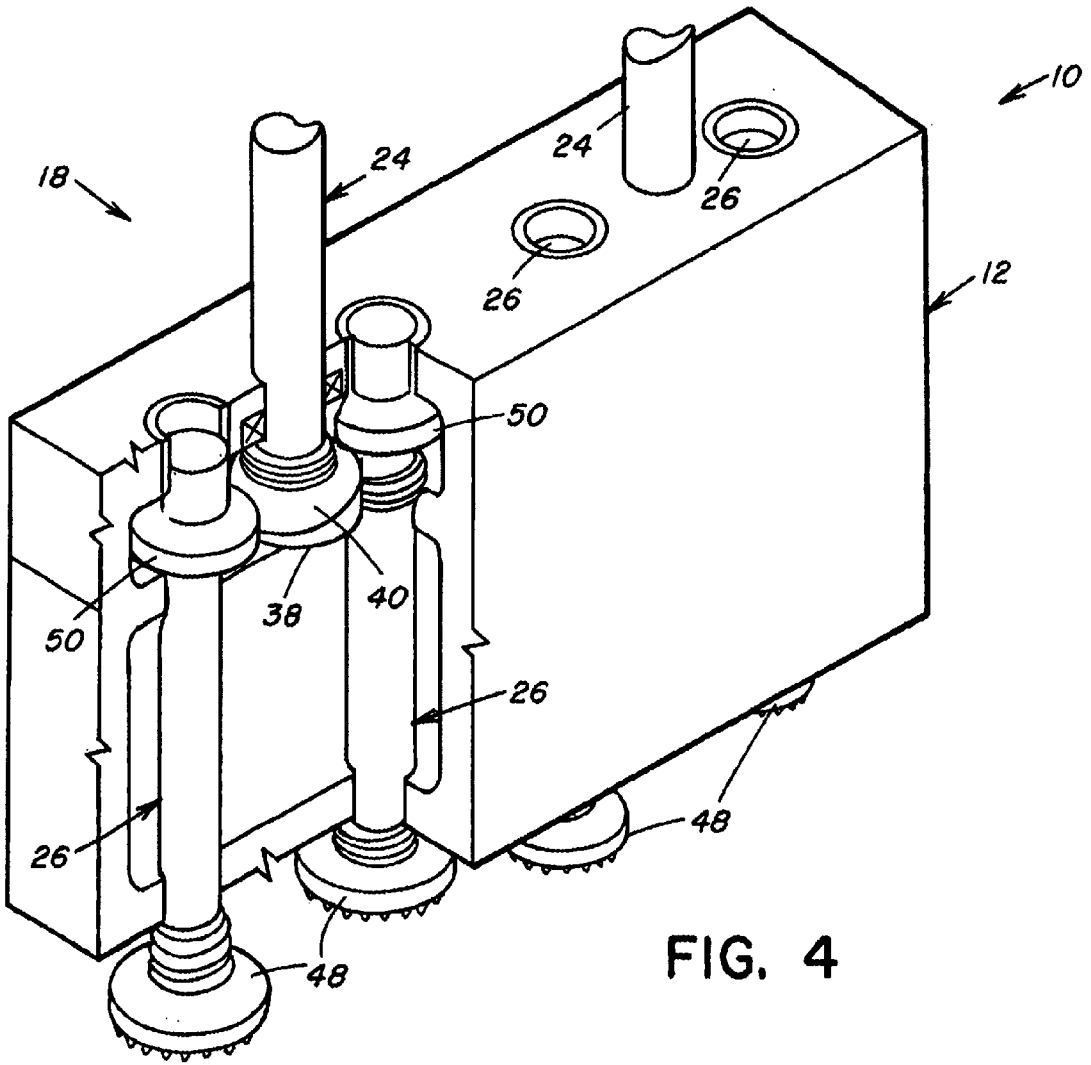
FIG. 4 is a longitudinally cutaway perspective view of a second embodiment of the operating mechanism employed by the apparatus of FIG. 1.
Figure 5:
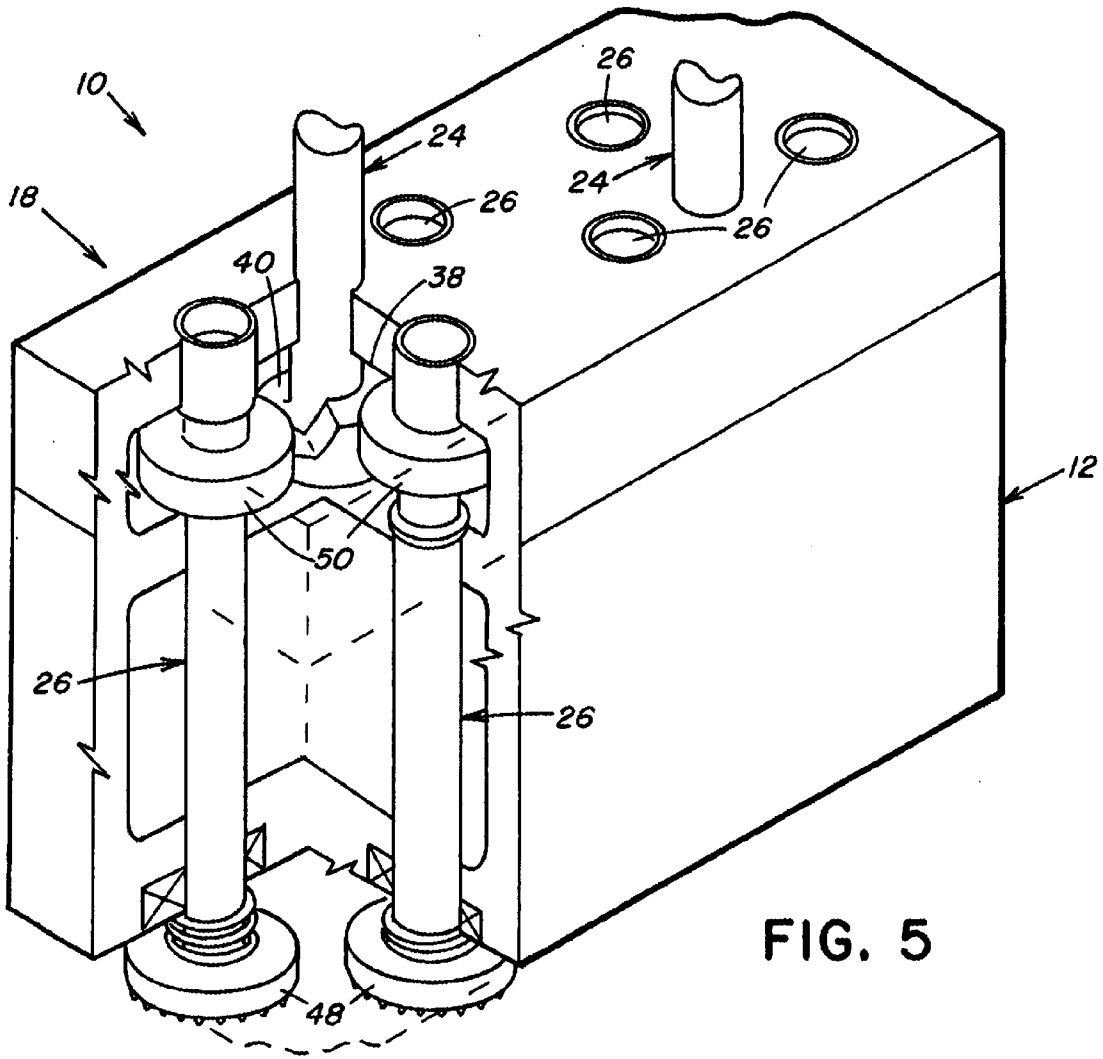
FIG. 5 is a longitudinally cutaway perspective view of a third embodiment of the operating mechanism employed by the apparatus of FIG. 1.

Referring to FIGS. 4 and 5, there is shown second and third embodiments of the operating mechanism 18 of the apparatus 10 also shown in a vertical orientation relative to the surface S to be abraded by the abrading heads 48. The second and third embodiments are basically the same as the first embodiment with respect to the various components making up the mechanism 18. The main difference of the second and third embodiments relative to the first embodiment is that in the second embodiment there are two reciprocal shafts 26 displaced approximately 180° from one another about the input drive shaft 24, whereas in the third embodiment there are three reciprocal shafts 26 displaced approximately 120° from one another about the input drive shaft 24.

Broadly speaking, the mechanism 18 provides a device for lifting spring loaded shafts 26 by using an input drive shaft 24 having a drive cam 38 thereon to lift and quickly release the shafts 26 to perform a variety of impact functions. This motion can be used lifting a single shaft or multiple shafts. The device can be small for some applications or large using multiple drive shafts. Also, a variety of tools can be attached to the shafts 26 to perform a number of different tasks, for instance, tools of different size carbide studded pads to lightly or severely abrade concrete and other fracturable materials or scraper blades to remove flooring materials, troweled down epoxy floors, etc., Smaller versions of the apparatus can be built into wood chisels and other devices for shaving wood, etc. The power to supply the rotary force to operate the input drive shaft, as mentioned above, can be an electric motor already available in the marketplace or one especially built into the apparatus. Also, as mentioned above, alternatively, a conventional hydraulic motor could be utilized. Another advantage is that multiple units of the apparatus 10 can easily be coupled together or run in tandem to accomplish more work.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An apparatus for reciprocally powering at least one working tool, said apparatus comprising:

(a) a casing;

(b) a motor mounted on said casing;

(c) at least one working tool; and (d) an operating mechanism mounted to said casing and supporting said working tool outside of said casing, said operating mechanism being drivingly coupled to said motor for causing an impacting movement of said working tool against a surface in response to selected operation by said motor, said operating mechanism including (i) at least one elongated shaft reciprocally mounted in said casing and having a lower end extending from said casing with said at least one working tool mounted thereon, (ii) an input drive shaft rotatably mounted in said casing parallel to said elongated shaft and rotatably driven by said motor, and (iii) means for lifting and releasing said elongated shaft with said working tool to reciprocally drive said elongated shaft to produce an impact movement of said working tool.

2. The apparatus of claim 1 wherein said means for lifting and releasing said elongated shaft includes a cam follower flange attached about said elongated shaft.

3. The apparatus of claim 2 wherein said means for lifting and releasing said elongated shaft further includes a spring disposed adjacent to said elongated shaft and being upwardly yieldable and adapted to impose a downwardly-directed biasing force on said cam follower flange.

4. The apparatus of claim 3 wherein said spring is a coil spring surrounding said upper end of said elongated shaft.

5. The apparatus of claim 3 wherein said means for lifting and releasing said elongated shaft still further includes an annular drive cam attached about said input drive shaft and an annular cam surface of a predetermined contour on said annular drive cam contacting said cam follower flange and adapted to sequentially lift said cam follower flange and elongated shaft against the biasing force of said spring and then abruptly release said cam follower flange and elongated shaft in response to rotation of said input drive shaft rotatably coupled to and driven by a rotary output shaft of said motor such that upon being abruptly released said elongated shaft is driven downwardly due to said biasing force imposed on said flange by said spring so as to cause forceable impact of said working tool with the surface.

6. The apparatus of claim 5 wherein said annular cam surface has a gradually inclined helical configuration with opposite lower and upper ends being vertically displaced from one another and interconnected by a steeply inclined ledge.

7. The apparatus of claim 5 wherein said elongated shaft also is rotatably mounted such that said contacting of said annular drive cam on said rotating input drive shaft with said cam follower flange on said elongated shaft turns said elongated shaft and said working tool therewith such that different areas of the surface are impacted by said tool.

8. An apparatus for reciprocally powering at least one working tool, comprising:

(a) a casing;

(b) a motor mounted on said casing;

(c) a plurality of working tools; and (d) an operating mechanism mounted to said casing and supporting said working tools outside of said casing, said operating mechanism being drivingly coupled to said motor for causing an impacting movement of said working tools against a surface in response to selected operation by said motor, said operating mechanism including (i) a plurality of elongated shafts each reciprocally mounted in the casing parallel to one another and having lower ends extending from the casing, each of said working tools being mounted to said lower end of one of said elongated shafts, (ii) an input drive shaft rotatably mounted in the casing between and parallel to the elongated shafts and rotatably driven by the motor, and (iii) means for lifting and releasing the elongated shafts and the working tools to reciprocally drive said elongated shafts along parallel axes to produce impact movements of the tools.

9. The apparatus of claim 8 wherein said elongated shafts are displaced approximately 90° from one another about said input drive shaft.

10. The apparatus of claim 8 wherein said elongated shafts are displaced approximately 180° from one another about said input drive shaft.

11. The apparatus of claim 8 wherein said elongated shafts are displaced approximately 120° from one another about said input drive shaft.

12. The apparatus of claim 8 wherein said means for lifting and releasing said elongated shafts includes a plurality of cam follower flanges each attached about one of said elongated shafts.

13. The apparatus of claim 12 wherein said means for lifting and releasing said elongated shafts further includes a plurality of coil springs each being disposed about one of said elongated shafts and being upwardly yieldable and adapted to impose a downwardly directed biasing force on said cam follower flanges.

14. The apparatus of claim 13 wherein said coil springs have different tensions so as to impose different biasing forces on said cam follower flanges.

15. The apparatus of claim 13 wherein said means for lifting and releasing said elongated shafts still further includes an annular drive cam attached about said input drive shaft and an annular cam surface of a predetermined contour on said annular drive cam contacting said cam follower flanges and adapted to sequentially lift said cam follower flanges and elongated shafts against the biasing force of said coil springs and then abruptly release said cam follower flanges and elongated shafts in response to rotation of said input drive shaft rotatably coupled to and driven by a rotary output shaft of said motor such that upon being abruptly released said elongated shafts are driven downwardly due to said biasing force imposed on said flanges by said coil springs so as to cause forceable impact of said working tools with the surface.

16. The apparatus of claim 15 wherein said annular cam surface has a gradually inclined helical configuration with opposite lower and upper ends being vertically displaced from one another and interconnected by a steeply inclined ledge.

17. The apparatus of claim 15 wherein said elongated shafts also are rotatably mounted such that said contacting of said annular drive cam on said rotating input drive shaft with said cam follower flanges on said elongated shafts turns said elongated shafts and said working tools therewith such that different areas of the surface are impacted by said tools.

18. A surface abrader apparatus, comprising:

(a) a casing;

(b) a plurality of impact abrading heads;

(c) a motor supported on said casing and having a rotary output shaft; and (d) an operating mechanism mounted in said casing and supporting said impact abrading heads outside of said casing such that said impact abrading heads can be brought into contact with a surface for causing abrading of the surface, said operating mechanism being drivingly coupled to said motor for causing an impacting movement of said impact abrading heads against the surface in response to selected operation by said motor, said operating mechanism including (i) a plurality of elongated shafts each reciprocally mounted in said casing parallel to one another and having lower ends extending from said casing, each of said impact abrading heads being mounted to said lower end of one of said shafts, (ii) an input drive shaft rotatably mounted in said casing between and parallel to said elongated shafts and rotatably driven by said rotary output shaft of said motor, and (iii) means for lifting and releasing said elongated shafts with said impact abrading heads to reciprocally drive said elongated shafts along parallel axes to produce impact movements of the tools.

19. The apparatus of claim 18 wherein said means for lifting and releasing said elongated shafts includes a plurality of cam follower flanges each attached about one of said elongated shafts.

20. The apparatus of claim 19 wherein said means for lifting and releasing said elongated shafts further includes a plurality of coil springs each disposed about one of said elongated shafts and being upwardly yieldable and adapted to impose downwardly directed biasing forces on said cam follower flanges.

21. The apparatus of claim 20 wherein said coil springs have different tensions so as to impose different biasing forces on said cam follower flanges.

22. The apparatus of claim 20 wherein said means for lifting and releasing said elongated shafts still further includes an annular drive cam attached about said input drive shaft and an annular cam surface of a predetermined contour on said annular drive cam contacted by said cam follower flanges and adapted to sequentially lift said cam follower flanges and elongated shafts against the biasing force of said springs and then abruptly release said cam follower flanges and elongated shafts in response to rotation of said input drive shaft rotatably coupled to and driven by a rotary output shaft of said motor such that upon being abruptly released said elongated shafts are driven downwardly due to said biasing force imposed on said flanges by said springs so as to cause forceable impact of said abrading heads with the surface.

23. The apparatus of claim 22 wherein said annular cam surface has a gradually inclined helical configuration with opposite lower and upper ends being vertically displaced from one another and interconnected by a steeply inclined ledge.

24. The apparatus of claim 22 wherein said elongated shafts also are rotatably mounted such that said contacting of said annular drive cam on said rotating input drive shaft with said cam follower flanges on said elongated shafts turns said elongated shafts and said working tools therewith such that different areas of the surface are impacted by said tools.

* * * * *